US007075441B2

(12) United States Patent
Tsukamoto

(10) Patent No.: US 7,075,441 B2
(45) Date of Patent: Jul. 11, 2006

(54) STUCK STATE DETECTION SEAL AND STUCK STATE DETECTION SYSTEM

(75) Inventor: Kazumasa Tsukamoto, Kuwana (JP)

(73) Assignees: Kazumasa Tsukamoto, Kuwana (JP); Crownt Corporation, Nagoya (JP)

( * ) Notice: Subject to any disclaimer, the term of this patent is extended or adjusted under 35 U.S.C. 154(b) by 191 days.

(21) Appl. No.: 10/780,991

(22) Filed: Feb. 18, 2004

(65) Prior Publication Data

US 2004/0246133 A1 Dec. 9, 2004

(30) Foreign Application Priority Data

Jun. 9, 2003 (JP) ..... 2003-163585

(51) Int. Cl.
*G08B 13/14* (2006.01)

(52) U.S. Cl. ..... 340/572.8; 248/551

(58) Field of Classification Search .. 340/572.1–572.9; 248/551

See application file for complete search history.

(56) References Cited

U.S. PATENT DOCUMENTS

| | | | | |
|---|---|---|---|---|
| 5,477,219 | A * | 12/1995 | Zarembo et al. | 340/572.3 |
| 5,767,772 | A | 6/1998 | Lemaire et al. | 340/571 |
| 5,955,951 | A * | 9/1999 | Wischerop et al. | 340/572.8 |
| 6,195,006 | B1 * | 2/2001 | Bowers et al. | 340/572.1 |
| 2004/0074974 | A1 * | 4/2004 | Senba et al. | 235/492 |

FOREIGN PATENT DOCUMENTS

| | | |
|---|---|---|
| JP | 10-301495 | 11/1998 |
| JP | 11-007245 | 1/1999 |
| JP | 11-024570 | 1/1999 |
| JP | 11-030957 | 2/1999 |
| JP | 11-304865 | 11/1999 |
| JP | 11-338353 | 12/1999 |
| JP | 2000-029390 | 1/2000 |
| JP | 2000-030161 | 1/2000 |
| JP | 2002-074286 | 3/2002 |

* cited by examiner

*Primary Examiner*—Jeffery Hofsass
*Assistant Examiner*—Jennifer Mehmood
(74) *Attorney, Agent, or Firm*—Burr & Brown

(57) ABSTRACT

A state where a seal is stuck to an article is detected, and an unauthorized takeout is prevented. A stuck state detection seal comprises a sealing base member to be stuck to the article N and a sealing surface member to be stuck to the sealing base member overlapped thereon. Between the sealing members, there are provided stuck state detection means for detecting a stuck state between the two and an RF unit that transmits a detected stuck state signal and transmits/receives a takeout state signal of the article N. In the store are provided passage reception antennas for receiving the stuck state signal transmitted from the RF unit, gate reception antennas for receiving reading state signal transmitted from a bar code reader through the RF unit, and a store control unit for judging whether the takeout of the article N be permitted based on the reading state signal.

8 Claims, 8 Drawing Sheets

【Fig . 1】
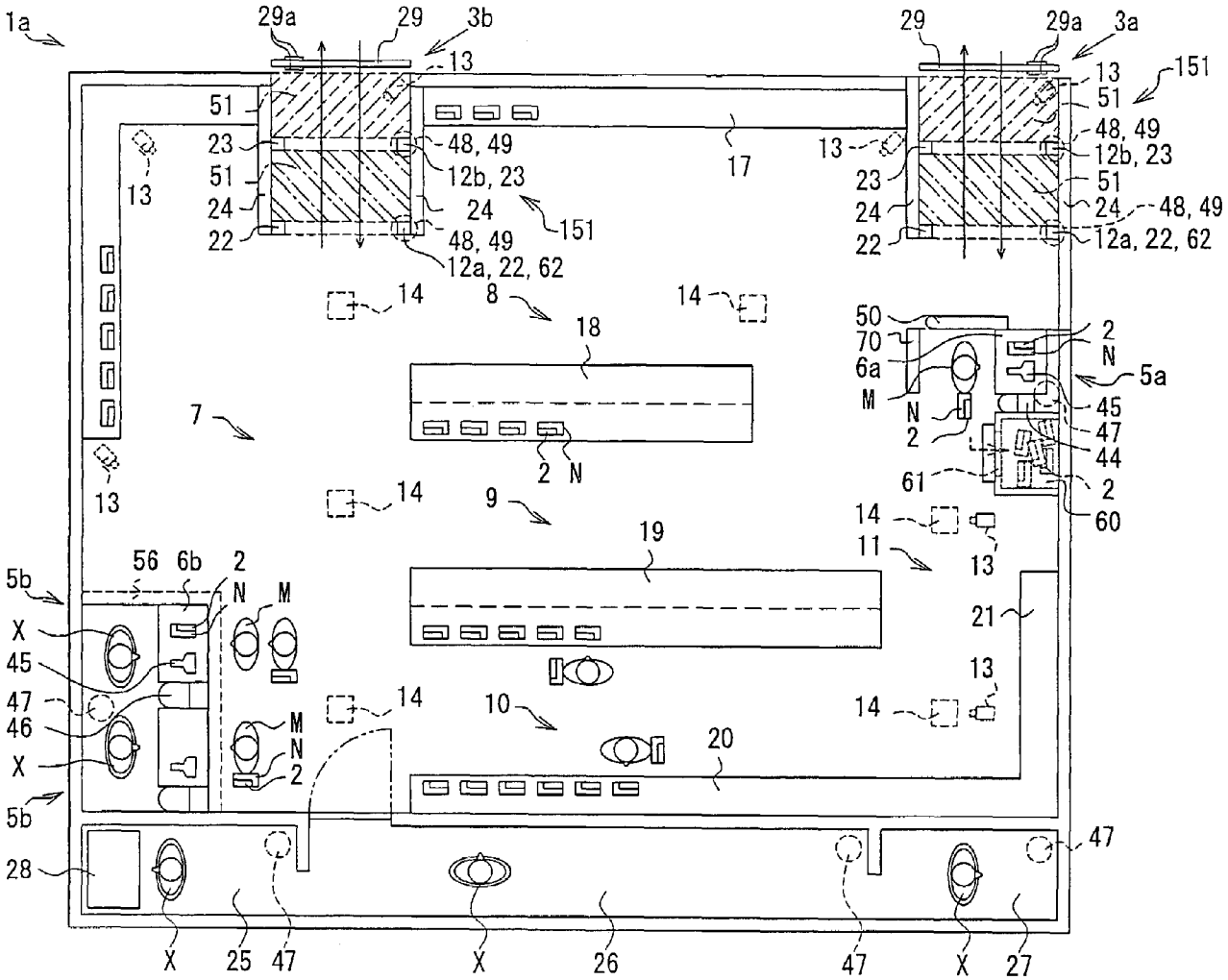

【Fig 2】
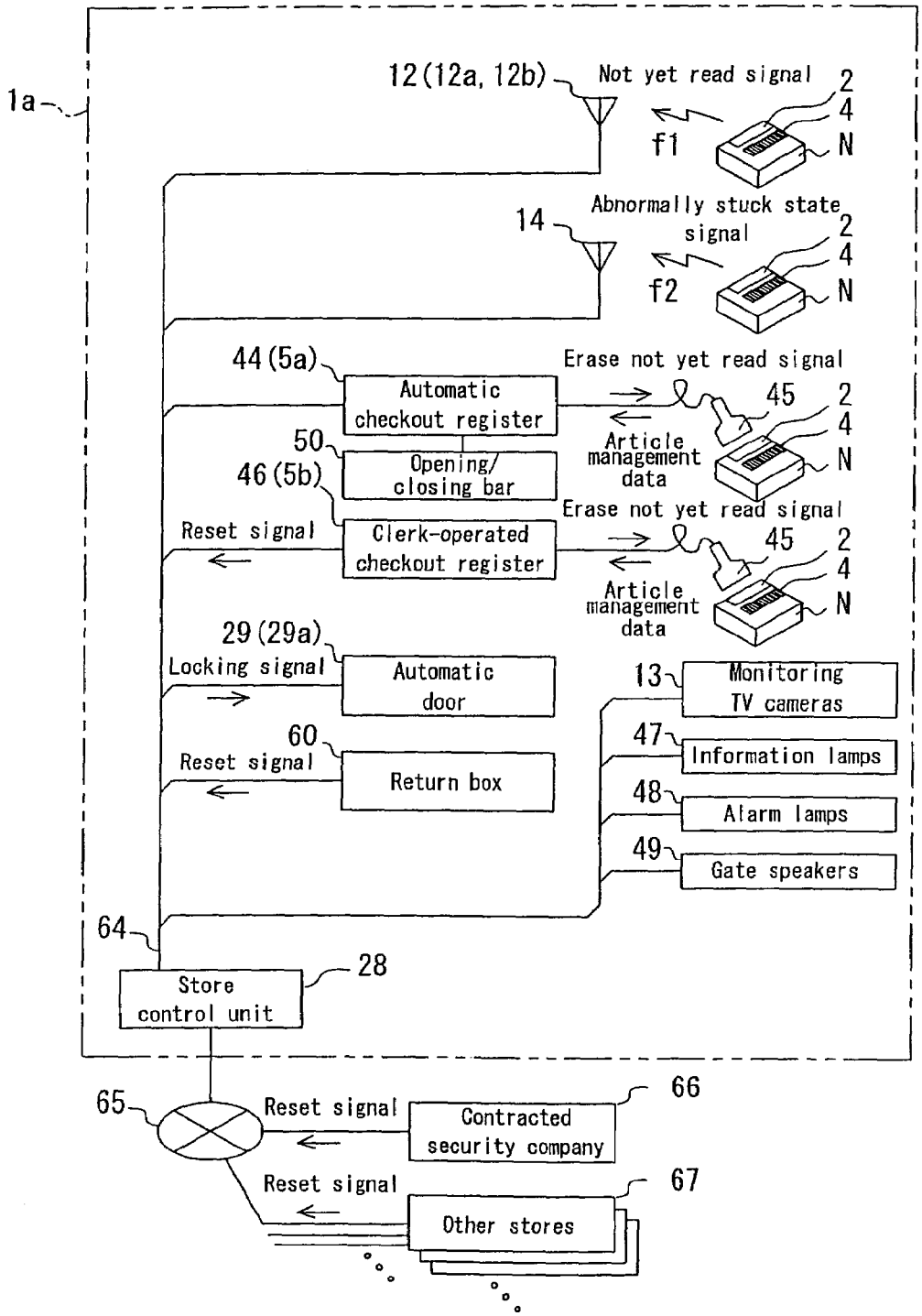

【Fig . 3】
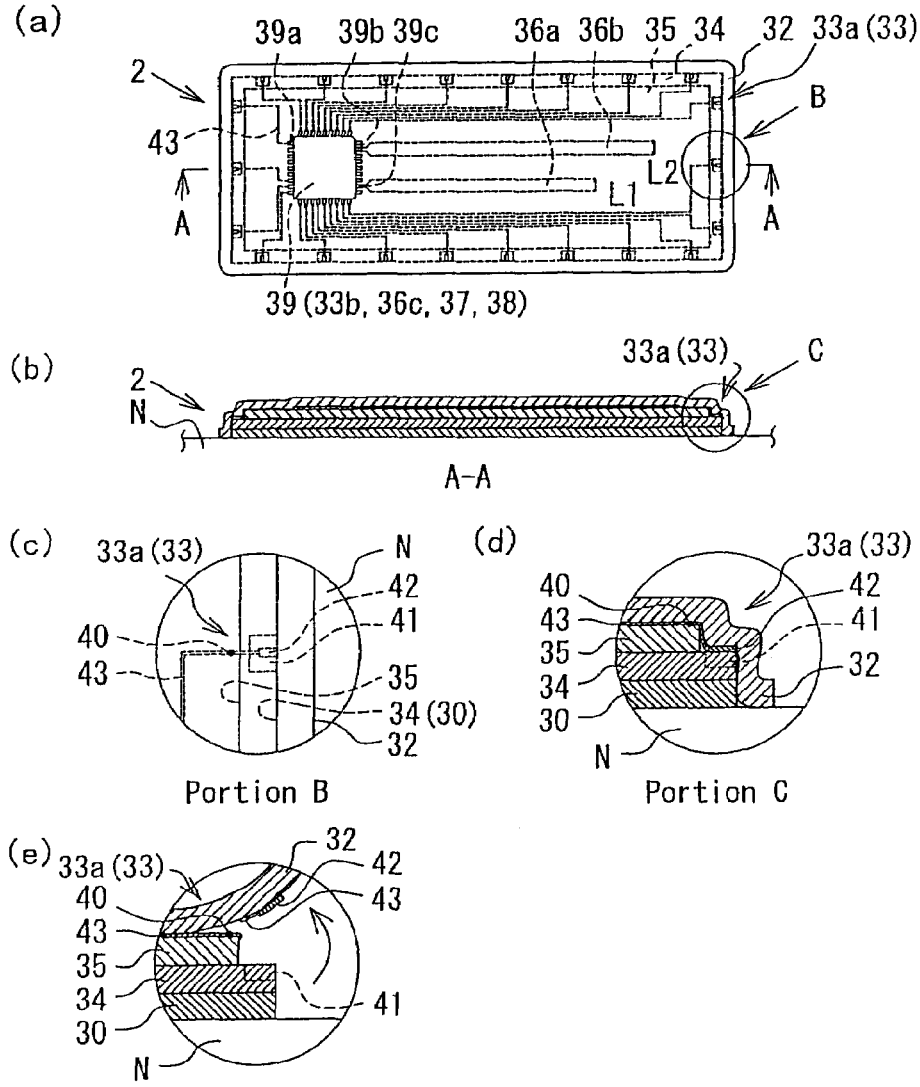

【Fig . 4】
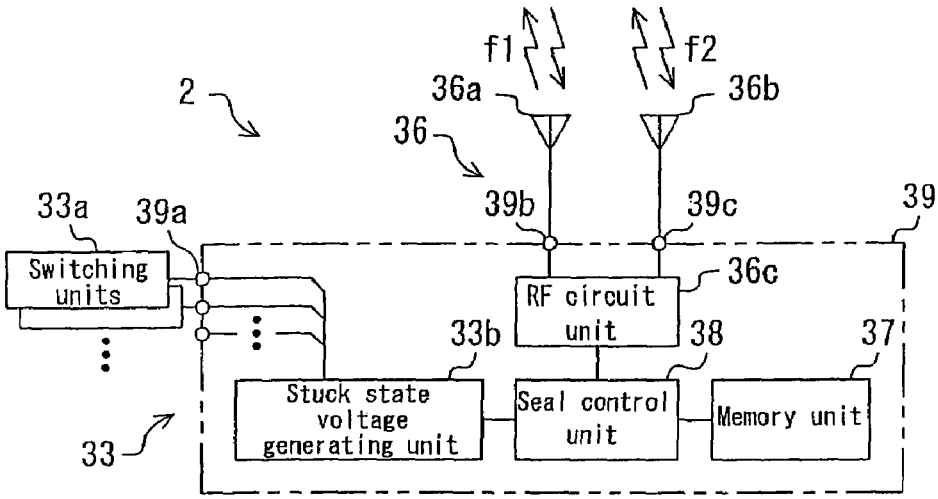

【Fig . 5】
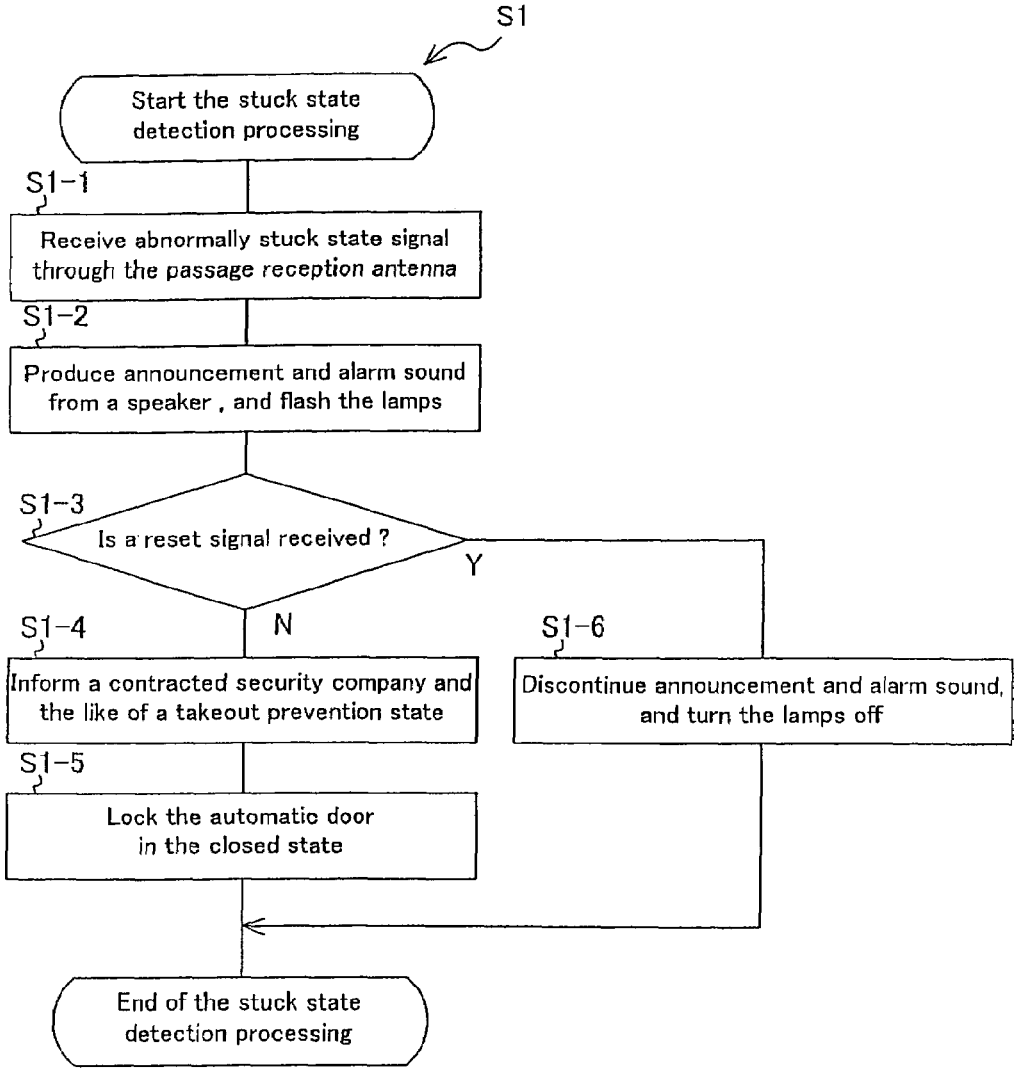

【Fig . 6】
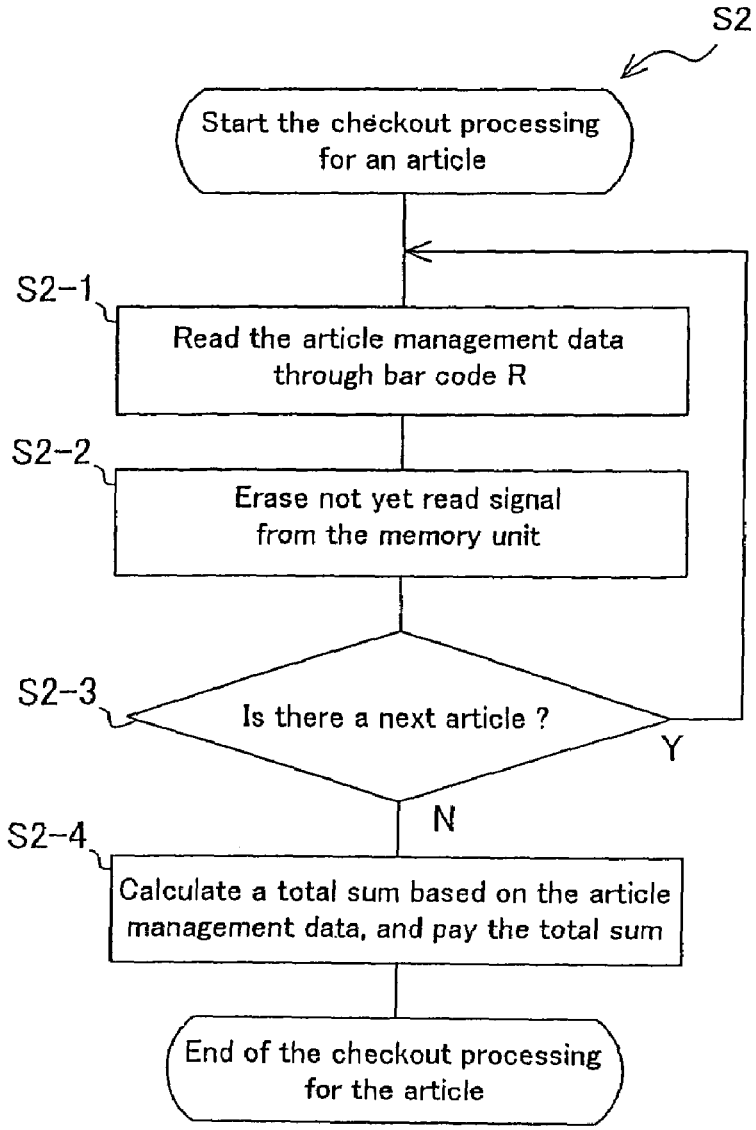

【Fig . 7】
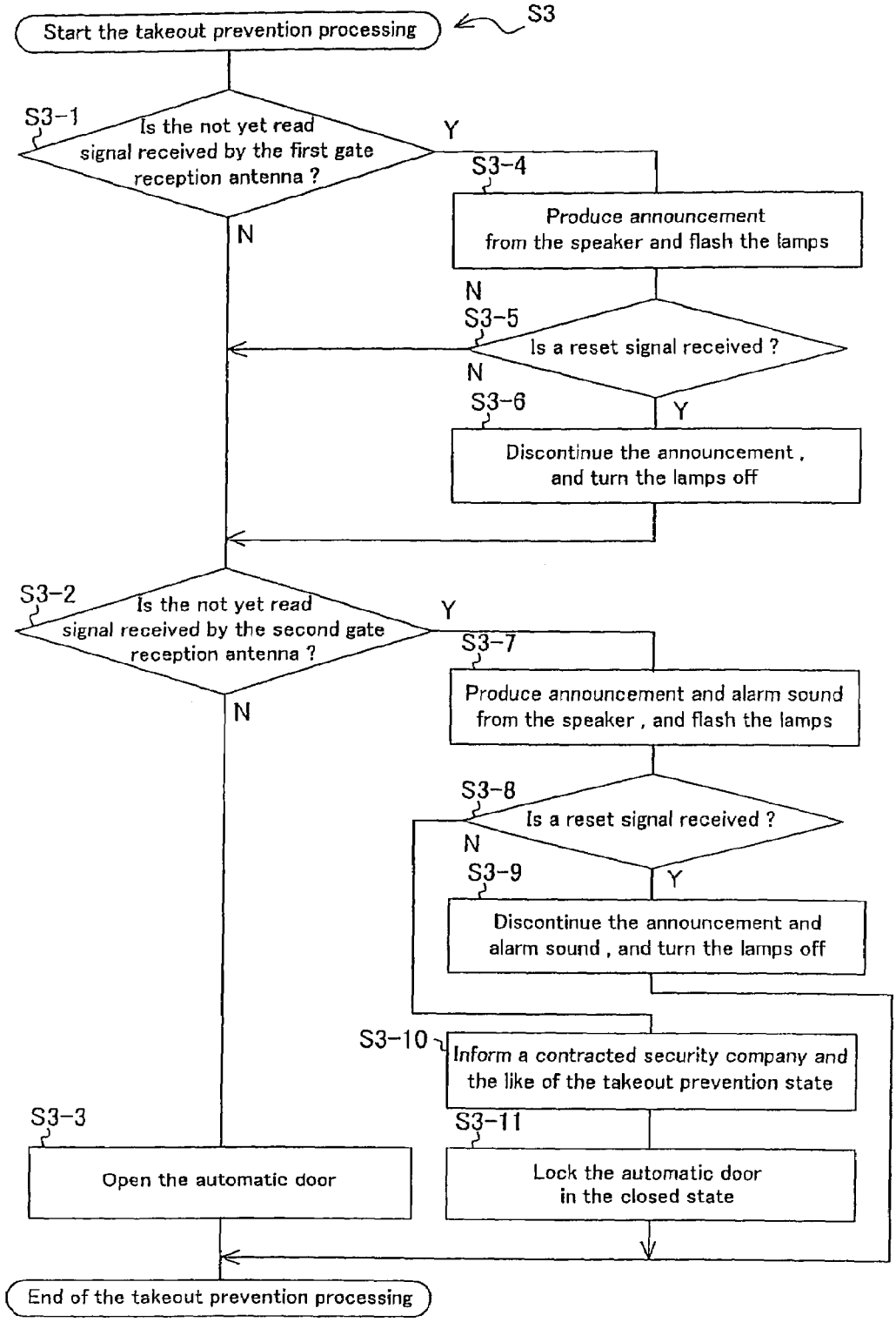

【Fig . 8】
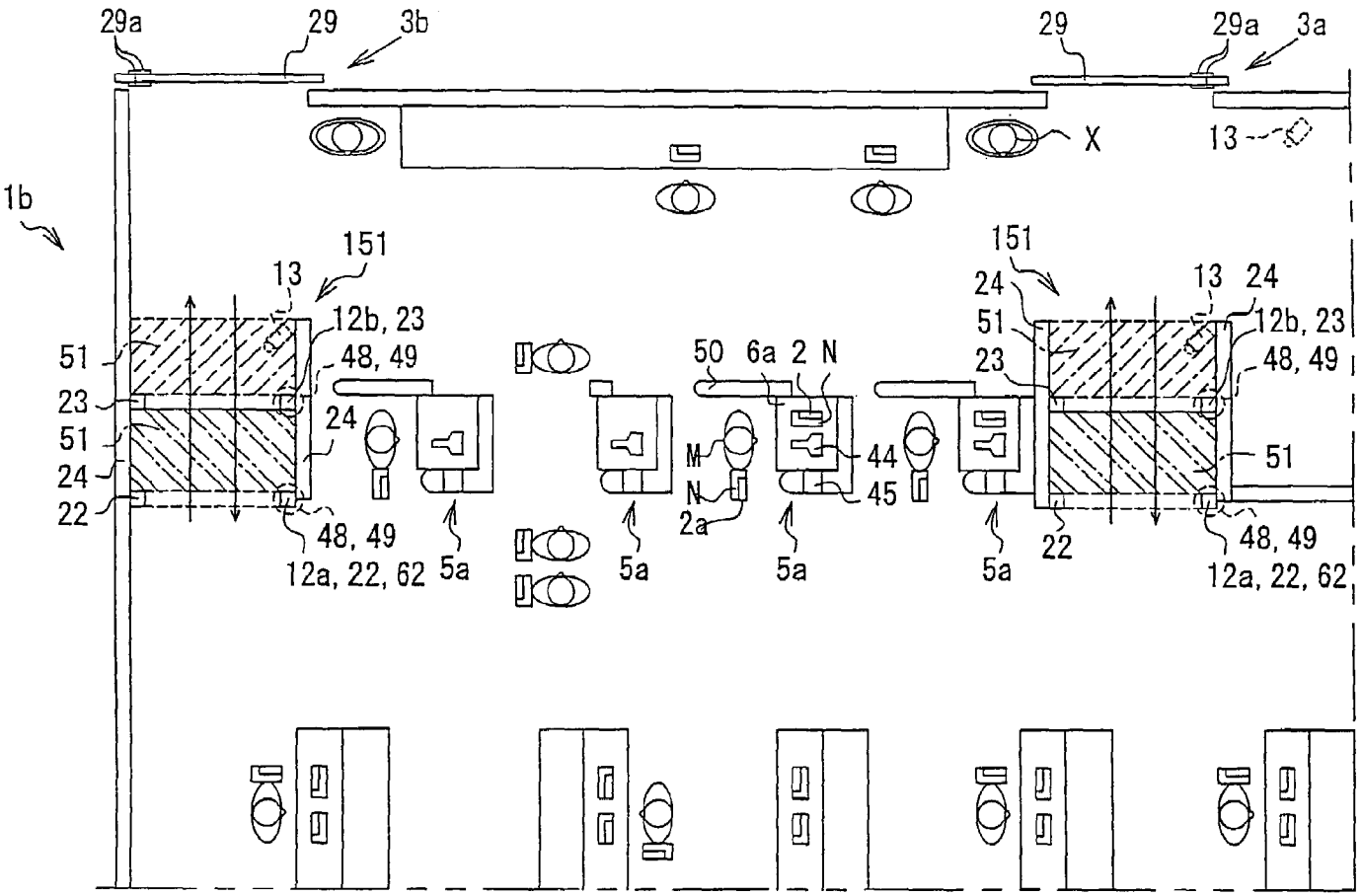

STUCK STATE DETECTION SEAL AND STUCK STATE DETECTION SYSTEM

BACKGROUND OF THE INVENTION

1. Field of the Invention

This invention relates to a stuck state detection seal that detects a state in which a seal is stuck to an article in a predetermined area and prevents the article stuck with the seal from being taken out from the predetermined area without authorization, and to a stuck state detection system.

2. Description of the Related Art

Technology has heretofore been proposed for managing a checkout of articles as well as preventing unauthorized takeout such as shoplifting as taught in JP-A-2002-74286. This technology uses an article management tag constituted by a sheet that can be stuck to an article, a storage unit incorporated in the sheet for storing data related to the article, and a polarity-holding portion made of a metal piece capable of holding a predetermined polarity. Data related to the article are written into the article management tag which is stuck to each article in a state of holding a predetermined polarity.

Further, an article management system using the article management tag comprises a gate installed near the entrance/exit of a merchandise sales store, and a polarity detector is provided in the gate for detecting the polarity held by state holding means, wherein when an article passes through the gate, the polarity of the article management tag is detected to permit the passage of only those articles with article management tags holding the polarity representing that the article was sold. This technology makes it possible to shorten the processing time for selling an article at the cashier as well as to prevent unauthorized takeout such as shoplifting.

The above technology, however, is based on a prerequisite that an article management tag has been stuck to the article, but cannot cope with such attempts as peeling the article management tag from the article without authorization. In case the article management tag is peeled off, the above technology can no longer manage the article, and further the article could be taken out without authorization.

SUMMARY OF THE INVENTION

In view of the above-mentioned problems, therefore, the present invention provides a stuck state detection seal and a stuck state detection system capable of detecting a state where a seal is stuck to an article and preventing the takeout of the article from a predetermined area without authorization.

According to a first aspect of the invention, a stuck state detection seal comprises:

a sealing base member to be stuck to an article, and a sealing surface member to be stuck to the article being overlapped on the sealing base member, wherein a stuck state detection means for detecting a stuck state between the sealing base member and the sealing surface member and for generating a stuck state signal that represents the detected stuck state, and a stuck state signal transmission means for transmitting the stuck state signal that represents the detected stuck state are provided between the sealing base member and the sealing surface member.

In a stuck state detection seal according to a second aspect of the invention, the stuck state detection means includes:

a switching means for switching operation depending upon a stuck state between the sealing base member and the sealing surface member;

a switched state signal generating means for generating a switched state signal corresponding to the switching operation of the switching means, and a control means for generating a stuck state signal corresponding to the switched state signal that is generated.

In a stuck state detection seal according to a third aspect of the invention, a takeout state signal transmission/reception means is provided between the sealing base member and the sealing surface member. The takeout state signal transmission/reception means transmits and receives a takeout state signal representing whether an article with the seal is authorized to be taken out from a predetermined area.

According to a fourth aspect of the invention, a stuck state detection system is for detecting, in a predetermined area, the stuck state between the sealing base member and the sealing surface member of the stuck state detection seal of the first or the second aspect, wherein a stuck state signal reception means for receiving a stuck state signal transmitted from the stuck state detection seal is provided.

According to a fifth aspect of the invention, a stuck state detection system is for detecting, in a predetermined area, the stuck state between the sealing base member and the sealing surface member of the stuck state detection seal of the third aspect, and for preventing unauthorized takeout of an article to which the stuck state detection seal is stuck, comprising:

a stuck state signal reception means for receiving a stuck state signal transmitted from the stuck state detection seal;

a takeout state signal transmission means for transmitting a takeout state signal to the takeout state signal transmission/reception means in the stuck state detection seal;

a takeout state signal reception means for receiving a takeout state signal transmitted from the takeout state signal transmission/reception means, and a judging means for judging whether or not the takeout of the article stuck with the seal is permitted or not based upon the takeout state signal received by the takeout state signal reception means, wherein the stuck state is detected based on the stuck state signal received by the stuck state signal reception means, and unauthorized takeout of the article with the seal is prevented based on the judgement by the judging means.

BRIEF DESCRIPTION OF THE DRAWINGS

FIG. 1 is a view of layout in a store illustrating an embodiment of a stuck state detection system according to the invention.

FIG. 2 is a block diagram illustrating the constitution of the store shown in FIG. 1.

FIG. 3 is a view illustrating an embodiment of a stuck state detection seal according to the invention. FIG. 3A is a front view, FIG. 3B is a sectional view along the line A—A, FIG. 3C is a view illustrating a portion B on an enlarged scale, FIG. 3D is a view illustrating a portion C on an enlarged scale, and FIG. 3E is a view illustrating the operation.

FIG. 4 is a block diagram illustrating the constitution of the stuck state detection seal shown in FIG. 3.

FIG. 5 is a flowchart illustrating a stuck state detection processing in the stuck state detection seal shown in FIG. 3.

FIG. 6 is a flowchart illustrating a checkout operation processing for an article in the store shown in FIG. 1.

FIG. 7 is a flowchart illustrating a customer's takeout attempt prevention processing in the store shown in FIG. 1.

FIG. 8 is a view of layout illustrating another embodiment in the store.

DESCRIPTION OF THE PREFERRED EMBODIMENTS

An embodiment of the invention will now be described in detail with reference to the drawings.

FIG. 1 is a view of layout of a merchandise sales store (hereinafter referred to as "store") 1*a* illustrating an embodiment of a stuck state detection system according to the invention, and FIG. 2 is a block diagram illustrating the constitution of the store 1*a*. The store 1*a* is formed in substantially a rectangular shape, and a first entrance/exit 3*a* and a second entrance/exit 3*b* are provided near both ends of one long wall so that the customers M enter and go out. The first and second entrances/exits 3*a*, 3*b* are provided with automatic doors 29 made of glass for opening and closing in the right-and-left direction. Touch switches 29*a* for opening/closing are provided on both surfaces of the glass of the automatic doors 29.

Adjacent to the first entrance/exit 3*a*, a takeout monitoring unit 151 is provided to monitor an article N taken out from the store 1*a* when the customer M leaves the store 1*a*. Near the takeout monitoring unit 151, an automatic checkout terminal 5*a* is set with which the customer M performs the "checkout operation" of the article N by himself. A similar takeout monitoring unit 151 is also installed near the second entrance/exit 3*b*. Along a short wall close to the second entrance/exit 3*b*, a sales clerk-operated checkout terminal 5*b* is provided with which a sales clerk X performs the "checkout operation" for the article N.

The automatic checkout terminal 5*a* is constituted by a bar code reader 45 which reads the article management data from a bar code 4 indicated on the article N, and an automatic checkout register 44 interlocked thereto. The automatic checkout terminal 5*a* is arranged on an automatic checkout counter 6*a* which is a working plate for performing "checkout operation".

Here, the "article management data" are, for example, those data that are standardized for managing the article, such as sales price of the article and the date of warehousing. The "checkout operation" includes the "reading operation" and the "payment operation" of the article. The "reading operation" is for reading the article management data for every article N through the bar code reader 45. The "payment operation" is for calculating the total sum of the articles N purchased through the automatic checkout register 44 based on the article management data of the articles N read by the "reading operation" and settles the payment for the total sum by cash or by a debit card.

For every "reading operation", in a non-contact manner the bar code reader 45 transmits a "reading operation state signal" to a stuck state detection seal 2 (see FIG. 3) stuck to the article N. The "reading operation state signal" represents the "reading operation state", that is, whether the "reading operation" is executed for the article N. Here, the "already read state" in which the "reading operation" for the article N has been executed is a "takeout permit state" permitting the article N to be taken out. On the other hand, the "not yet read state" in which the "reading operation" has not been executed is a "takeout prevention state" prohibiting the takeout of the article N. In the following description, the "reading operation state" represents the "takeout state" and the "reading operation state signal" represents the "takeout state signal". In this embodiment, therefore, the bar code reader 45 is constituted as takeout state signal transmission means for transmitting a "reading operation state signal" to the stuck state detection seal 2.

The automatic checkout register 44 includes payment operation buttons for the customers M, a display panel displaying the procedure of checkout operation and the total sum, a cash insertion port and a debit card insertion port through which the customers M pay for the articles, and a change return port and a receipt-issuing port. By the side of the automatic checkout counter 6*a*, a return box 60 for returning the articles N that are returned back is provided. In the return box 60, a return port 61 is provided for putting the article N. In front of the automatic checkout register 44, a partitioning wall 70 is provided having a predetermined distance to keep space for carrying out the "checkout operation". Further, on the first entrance/exit 3*a*'s side of the automatic checkout counter 6*a*, an opening/closing bar 50 is provided for opening to let the customer M pass through only when the "checkout operation" is properly conducted.

On the other hand, the sales clerk-operated checkout terminal 5*b* is constituted by a bar code reader 45 similar to the automatic checkout terminal 5*a* and a sales clerk-operated checkout register 46. The sales clerk-operated checkout terminal 5*b* is placed on a sales clerk checkout counter 6*b* which is a working plate for conducting the "checkout operation" by the sales clerks X. Different from the automatic checkout terminal 5*a*, the "checkout operation" by the sales clerk-operated checkout terminal 5*b* is conducted by the sales clerks X. A shutter 56 as an isolation means is stored in the ceiling so as to be raised and lowered to isolate the customers M from the sales clerk-operated checkout terminal 5*b* and the sales clerk checkout counter 6*b*.

The store 1*a* is so constituted as to be operated in two kinds of store modes, i.e., an ordinary store mode executing the "checkout operation" by using both the automatic checkout terminal 5*a* and the sales clerk-operated checkout terminal 5*b*, and an unattended store mode executing the "checkout operation" by using the automatic checkout terminal 5*a* only. In the ordinary store mode, the shutter 56 is stored in the ceiling so that the sales clerks X can execute the "checkout operation". On the other hand, in the unattended store mode, the shutter 56 is lowered from the ceiling so as to separate the customers M from the sales clerk-operated checkout terminal 5*b*, so that unnecessary "checkout operation" will not be executed.

The takeout monitoring unit 151 includes a first gate 22, a second gate 23 and a pair of guide walls 24. In the second gate 23, a pair of poles stands in parallel, having a predetermined distance from the first entrance/exit 3*a*. In the first gate 22, a pair of poles stands in parallel, having a predetermined distance from the second gate 23. The guide walls 24 stand so as to connect the frontage of the first entrance/exit 3*a* to the poles of the first and second gates 22, 23. As a result, a guide path 51 is provided for guiding the entrance and exit of the customers M.

The poles of the first gate 22 and of the second gate 23 contain gate reception antennas 12 (first gate reception antenna 12*a* and second gate reception antenna 12*b*) as takeout state signal reception means that receive radio waves of a predetermined frequency f1. The poles on one side of the gates includes alarm lamps 48 and gate speakers 49 at their ends for warning a customer M who attempts to take out the article N with which "reading operation" has not been executed through the automatic checkout terminal 5*a* or the sales clerk-operated checkout terminal 5*b*.

In front of the sales clerk-operated checkout terminal 5*b*, there is a first passage 7 which communicates the second entrance/exit 3*b* with the back of the store as well as provides space for the customers M who queue up waiting for the "checkout operation" for the articles N. A first display rack 17 for displaying articles N is provided along the long wall between the first entrance/exit 3*a* and the second entrance/exit 3*b*. Then, a second display rack 18 is provided on a parallel with the first display rack 17 across a second passage 8, a third display rack 19 across a third passage 9, and a fourth display rack 20 along the opposing long wall across a fourth passage 10. Along a short wall close to the first entrance/exit 3*a*, there is provided a fifth display rack 21 across a fifth passage 11 which is at right angles with the second to fourth passage 8 to 10.

On the ceiling at intersecting positions of the first passage 7 to the fifth passage 11, there are provided six passage reception antennas 14 which are the stuck state signal reception means that receive "stuck state signals" which are radio waves of a predetermined frequency f2 transmitted from the stuck state detection seal 2. On the ceiling of the store, there are further provided three monitoring TV cameras 13 at positions for monitoring the second passage 8 to fourth passage 10, two monitoring TV cameras 13 on the side of the sales clerk-operated checkout terminal 5*b*, one monitoring TV camera 13 at the first entrance/exit 3*a*, and one monitoring TV camera 13 at the second entrance/exit 3*b*.

The store 1*a* further includes a management chamber 25 where a store control unit 28 is installed for systematically controlling the facilities in the store such as automatic checkout terminal 5*a*, sales clerk-operated checkout terminal 5*b*, etc. In addition, the store 1*a* includes an inventory room 26 for articles N, a room for rest 27 for sales clerks, etc. Information lamps 47 are provided respectively on the ceiling over the automatic checkout terminal 5*a*, sales clerk-operated checkout terminal 5*b*, management chamber 25, inventory chamber 26 and a room for rest 27 for sales clerks to inform the sales clerks X of the control operation state of the store control unit 28.

Referring to FIG. 2, the store control unit 28 is connected to the automatic checkout terminal 5*a*, sales clerk-operated checkout terminal 5*b*, gate reception antennas 12, monitoring TV cameras 13, passage reception antennas 14, automatic doors 29, touch switches 29*a*, information lamps 47, alarm lamps 48, gate speakers 49, opening/closing bars 50 and return box 60 in the store 1*a* through a transmission line 64 so as to control them in an interlocked manner, as well as to constitute judging means for judging whether or not the article N is permitted to be taken out. The store control unit 28 works in either the ordinary store mode or the unattended store mode which may be changed over to each other. Further, the store control unit 28 is connected to a contracted security company 66 and to other stores 67 through a public telephone circuit 65, so that the control operation state can be monitored by each other.

Articles N displayed on the first display rack 17 to the fifth display rack 21 in the store 1*a* are bearing bar codes 4 used in "checkout operation" and are stuck with stuck state detection seals 2 for preventing the articles N from being taken out from the store 1*a* without authorization. FIG. 3 is a view illustrating the stuck state detection seal 2 according to the present invention, wherein FIG. 3A is a front view, FIG. 3B is a sectional view along the line A—A, FIG. 3C is a view illustrating a portion B on an enlarged scale, FIG. 3D is a view illustrating a portion C on an enlarged scale, and FIG. 3E is a view illustrating the operation. FIG. 4 is a block diagram illustrating the constitution of the stuck state detection seal 2.

The stuck state detection seal 2 includes a sealing base member 30 that will be stuck to an article N, and a sealing surface member 32 stuck to the sealing base member 30 overlapped thereon. Between the sealing base member 30 and the sealing surface member 32, there is provided stuck state detection means 33 for detecting whether the stuck state is "normally stuck state" in which the sealing surface member 32 is intimately adhered to the article N or "abnormally stuck state" in which at least peripheral edges of the sealing surface member 32 are peeled off the article N.

Between the two sealing members 30 and 32, there are further provided an RF unit 36 which works as reading operation state signal transmission/reception means (takeout state signal transmission/reception means) for transmitting and receiving "reading operation state signal (takeout state signal)" representing whether or not the takeout of the article N from the store 1*a* is permitted and further works as stuck state signal transmission means for transmitting the "stuck state signal" detected by the stuck state detection means 33 to the passage reception antennas 14, a memory unit 37 for storing the "reading operation state signal" and the "stuck state signal" in a manner that they can be read out and written freely, and a seal control unit 38 for controlling the operation of the RF unit 36 and the memory unit 37. The reading operation state signal transmission/reception means receives the "reading operation state signal" transmitted in a non-contacting manner from the bar code reader 45 of the automatic checkout terminal 5*a* or the sales clerk-operated checkout terminal 5*b*, and transmits the "reading operation state signal" to the gate reception antennas 12.

The stuck state detection means 33 is constituted by a switching unit 33*a* which is so formed as to effect the switching operation depending upon the two stuck states, i.e., the "normally stuck state" and the "abnormally stuck state" between the two sealing members 30 and 32, and a stuck state voltage generating unit 33*b* which is switched state signal generating means for generating a "switched state signal" corresponding to the switching operation of the switching unit 33*a*. The stuck state voltage generating unit 33*b* produces "switched state signals" having two different voltages corresponding to the switching operations, i.e., to the stuck states. The switching units 33*a* are provided at 22 places along the peripheral edge portions of the two sealing members 30 and 32 maintaining an equal distance.

The RF unit 36 comprises an antenna element 36*a* made of a thin metal film formed in the shape of an elongated belt having a length L1 that meets the radio transmission frequency f1 of the gate reception antenna 12, an antenna element 36*b* similarly formed having a length L2 that meets the radio transmission frequency f2 of the passage reception antenna 14, and an RF circuit unit 36*c* which wirelessly transmits "reading operation state signals" maintaining predetermined radiation characteristics through the antenna element 36*a* and wirelessly transmits "stuck state signals" maintaining predetermined radiation characteristics through the antenna element 36*b*.

The stuck state voltage generating unit 33*b*, RF circuit unit 36*c*, memory unit 37 and seal control unit 38 are accommodated in an IC chip 39 in the form of a single chip. Further, the IC chip 39 contains a small cell as a power source for driving the stuck state voltage generating unit 33*b*, RF circuit unit 36*c*, memory unit 37 and seal control unit 38. The IC chip 39 is provided with 22 switch input terminals 39*a* that are connected to 22 switching units 33*a*, and with an input/output terminal 39*b* and an input/output terminal 39*c* for wirelessly transmitting "reading operation state signal" and "stuck state signal" from the RF circuit unit 36*c*.

The sealing base member 30 is made of a film of polyester or vinyl chloride in a rectangular shape, and is coated on the lower surface thereof with a sticking agent for sticking the sealing base member 30 to any position of the article N. Onto the whole upper surface of the sealing member 30 is adhered a grounding film 34 which is a thin metal conductor film. On the grounding film 34 is further stuck a dielectric film 35 of a highly dielectric material formed in a rectangular shape smaller than the grounding film 34 so that a belt-like metallic conductor is exposed to the inside of the peripheral edges of the grounding film 34. The antenna elements 36*a*, 36*b* and the IC chip 39 are provided at the center of the dielectric film 35. The antenna elements 36*a* and 36*b* are constituted as plane antennas of a micro-strip type in combination with the grounding film 34 having the dielectric layer 35 therebetween.

The sealing surface member 32 is formed in a rectangular shape larger than the above layers so as to extend beyond the whole peripheral edges of the grounding film 34 and the sealing base member 30 by an equal width. The sealing surface member 32 is overlapped as the uppermost layer so as to cover the whole of antenna elements 36*a*, 36*b*, IC chip 39, switching units 33*a*, as well as dielectric film 35, grounding film 34 and sealing base member 30. At the lower surface of the sealing surface member 32, a sticking agent is applied for sticking to the lower layer constitution and to the articles N. The sealing surface member 32 is made of the same film material as the sealing base member 30.

Each switching unit 33*a* is constituted by a first contact 40 formed as an end of a pattern 43 on the dielectric film 35 and is positioned on the inside of the peripheral edge of the dielectric film 35 maintaining a very small distance, a second contact 41 defined on the grounding film 34 exposed on the outer side of the dielectric film 35 close to the first contact 40, and an extended contactor 42 in the shape of a very fine belt formed by extending the metal conductor from the first contact 40 by a length so as to be connected to the second contact 41. The extended contactor 42 is made of a metallic material having a required resistance.

The first contact 40 is connected to the switch terminal 39*a* of the IC chip 39 through a pattern 43 of a metallic conductor arranged on the dielectric film 35 and is, further, connected to the stuck state voltage generating unit 33*b* in the IC chip 39 through the switch terminal 39*a*. The stuck state voltage generating unit 33*b* is connected to the memory unit 37 through the seal control unit 38 so as to read and write "stuck state signal" therefrom and therein.

The antenna element 36*a* is connected to the RF circuit unit 36*c* through the "reading operation state signal" input/output terminal 39*b* of the IC chip 39, and the antenna element 36*b* is connected to the RF circuit unit 36*c* through the "stuck state signal" input/output terminal 39*c* of the IC chip 39. Further, the RF circuit unit 36*c* is connected to the memory unit 37 through the seal control unit 38 so as to read and write "reading operation state signal" and "stuck state signal" therefrom and therein.

Next, described below is the stuck state detection operation of the stuck state detection seal 2. In a state where the switching unit 33*a* is switched to the "normally stuck state", the lower peripheral edges of the sealing surface member 32 extending beyond the whole peripheral edges of the sealing base member 30 are stuck to the article N, and the first contacts 40 are connected to the second contacts 41 through the extended contactors 42 (see FIG. 3D).

Under the "normally stuck state", the input terminal of the stuck state voltage generating unit 33*b* terminates to the grounding film 34 through the extended contactor 42, and a "switched state signal" of a potential lower than a predetermined standard potential is input to the seal control unit 38. Upon detecting the potential of the "switched state signal", the seal control unit 38 judges that the stuck state detection seal 2 is stuck to the article N in a "normally stuck state", and writes the normally stuck state data into the memory unit 37 to store it. The seal control unit 38, then, continues to detect the potential input to the input terminals.

On the other hand, the switching unit 33*a* may be switched to the "abnormally stuck state" in case the stuck state detection seal 2 is peeled off the article N by, for example, a customer M. This state is reached as the peripheral edge of the sealing surface member 32 is partly peeled off. At this moment, the extended contactor 42 is torn apart from the second contact 41 and, further, from the first contact 40 together with part of the peripheral edges of the sealing surface member 32 peeled off the article N (see FIG. 3E).

Under the "abnormally stuck state", the input terminal of the stuck state voltage generating unit 33*b* that is terminated to the grounding film 34 is separated from the grounding film 34, and a "switched state signal" of a potential higher than the standard potential is input to the seal control unit 38. Upon detecting the potential of the "switched state signal", the seal control unit 38 judges that the stuck state detection seal 2 is stuck to the article N in an "abnormally stuck state", and writes the abnormally stuck state data into the memory 37 to store it. Thus, the seal control unit 38 generates a corresponding "stuck state signal" based on the "switched state signal" that is generated. After the writing, the seal control unit 38 transmits "abnormally stuck state signal" representing the "abnormally stuck state" from the antenna element 36*b* to the passage reception antennas 14 in the store 1*a* as radio waves of the frequency f2 for a predetermined period of time.

By utilizing the stuck state detection seal 2, the stuck state detection processing for detecting the stuck state to the article N is conducted in the store 1*a*. FIG. 5 is a flowchart illustrating the stuck state detection processing (S1) of the stuck state detection seal 2 stuck to the article N by the store control unit 28 in the store 1*a* illustrated in FIG. 1. In its initial state, the control operation state of the store control unit 28 is in a "reception waiting state" for receiving "abnormally stuck state signal" through the passage reception antennas 14 that receive "abnormally stuck state signal" transmitted from the stuck state detection seal 2 at the frequency f2.

When the stuck state detection seal 2 is peeled off the article N by the customer M, the stuck state detection seal 2 transmits the "abnormally stuck state signal" to the passage reception antennas 14 in the form of radio waves of the frequency f2 for a predetermined period of time due to the switching operation of the switching unit 33*a*. Then, the passage reception antenna 14 in the "reception waiting state" receives the "abnormally stuck state signal" (S1-1), and the control operation state of the store control unit 28 is shifted to a "peel precaution state" to exercise precaution against the customer's unauthorized attempt for removing the stuck state detection seal 2 from the article N.

In the "peel precaution state" in the ordinary store mode, the store control unit 28 produces a prerecorded warning announcement stating that the stuck state detection seal 2 is being peeled off the article N as well as alarm sound from the speakers (not shown) for internal broadcast installed on the ceiling of the store 1*a* to warn the customer M. The information lamps 47 are flashed (S1-2) to inform the sales clerks X of the "peel precaution state" to exercise precaution. In the unattended store mode, a contracted security company 66 is informed of the "peel precaution state" through the public telephone circuit 65 to request the assistance for precaution. A guard in charge of the contracted security company 66 remotely controls the monitoring TV cameras 13 to make sure the circumstances in the store, directly delivers the warning announcement through the speakers on the ceiling stating that the stuck state detection seal 2 is being peeled off the article N to thereby warn the customer M.

Thereafter, the store control unit 28 waits for the reception of a reset signal for resetting the "peel precaution state" (S1-3). The reset signal is for resetting the "peel precaution state" when the control operation state is shifted to the "peel precaution state" against the will of the customer M like when the stuck state detection seal 2 is peeled off the article N due to, for example, defective product or aging. The customer M can execute the reset operation by putting the article N into a return port 61 of the return box 60, so that a reset output is sent to the store control unit 28 from the return box 60. In the ordinary store mode, the reset signal can be output to the store control unit 28 by the resetting operation executed by a sales clerk X by using the sales clerk-operated checkout terminal 5*b*. In the unattended store mode, the reset signal can be output to the store control unit 28 by the remote resetting operation from the contracted security company 66.

When the reset signal is received (S1-3Y), the warning announcement and the alarm sound are no longer output from the speakers on the ceiling, and the information lamps 47 are turned off (S1-6) to end the stuck state detection processing. On the other hand, when no reset signal is received (S1-3N), the control operation state of the store control unit 28 is shifted to the "takeout prevention state" to prevent the customer M's attempt for taking out the article N from the store 1*a*.

In the "takeout prevention state" in the ordinary store mode and in the unattended store mode, the store control unit 28 informs the contracted security company 66 and other stores 67 of the "takeout prevention state" through the public telephone circuit 65 (S1-4), and requests the contracted security company 66 and other stores 67 to assist for the "takeout prevention state". Further, the monitoring TV cameras 13 are operated to record the pictures, and the automatic doors 29 are locked in the closed state (S1-5) to end the stuck state detection processing.

In the unattended store mode, in particular, the contracted security company 66 makes sure the state in the store 1*a* by remotely controlling the monitoring TV cameras 13 and may dispatch the guards in charge to the store 1*a* depending upon the situations. When it is clarified that the "takeout prevention state" is assumed contrary to the will of the customer M, the sales clerk X or the contracted security company 66 may execute the reset operation to reset the "takeout prevention state" and to end the stuck state detection processing. According to this stuck state detection processing, the customer M is prevented from leaving the store carrying with him the article N from which the stuck state detection seal 2 is peeled off but is kept to stay in the store 1*a*.

The store 1*a* is further so constituted as to execute the checkout operation processing for the articles N by using the bar codes 4 of the articles N and the stuck state detection seals 2, and to execute the processing for preventing the takeout of articles N by the customer M from the store 1*a*. In their initial state, the stuck state detection seals displayed on the first display rack 17 to the fifth display rack 21 in the store 1*a* are in the "not yet read state (takeout prevention state)" without being put to the "reading operation" for the article N, and a "not yet read signal" representing the "not yet read state" is written into the memory unit 37. The stuck state detection seal 2 is intermittently transmitting the "not yet read signal" from the antenna element 36*b* as radio waves of the predetermined frequency f1.

FIG. 6 is a flowchart illustrating the checkout operation processing for the article N in the store 1*a* in FIG. 1. To exactly calculate the article N, the customer M brings the article N bearing the stuck state detection seal 2 to the automatic checkout counter 6*a* or to the sales clerk checkout counter 6*b* to have the checkout operation processing executed (S2).

Article management data such as the sales price of the article N and the like are read out by using the bar code reader 45 at the automatic checkout register 44 or at the sales clerk-operated checkout register 46 (S2-1). Every time when the article management data are read out, the bar code reader 45 erases the "not yet read signal" that had been written into the memory unit 37 in the stuck state detection seal 2 and discontinues the transmission of "not yet read signal" that had been transmitted from the antenna element 36*b* (S2-2). The "reading operation" comprising the processing "S2-1" and the processing "S2-2" is executed for every article N to be purchased (S2-3). The total sum is calculated based on the article management data of the articles N, and the customer M executes the "payment operation" to pay the total sum (S2-4). The checkout operation processing is thus finished. At the automatic checkout terminal 5*a*, the opening/closing bar 50 opens after "S2-4".

FIG. 7 is a flowchart illustrating a processing for preventing the takeout of article N executed by the store control unit 28 in the store 1*a* shown in FIG. 1 (S3). When leaving the store 1*a*, every customer M passes through the first gate 22 and the second gate 23 of the takeout monitoring unit 151, and goes out from the first entrance/exit 3*a* or the second entrance/exit 3*b*. In its initial state, the control operation state of the store control unit 28 is in the "reception waiting state" for receiving, through the first gate reception antenna 12*a*, the "not yet read signal" which is the "reading operation state signal" transmitted from the stuck state detection seal 2 when the customer M passes through the first gate 22.

The store control unit 28 receives, through the first gate reception antenna 12*a*, a "reading operation state signal" from the stuck state detection seal 2 stuck to the article N which is to be taken out by the customer M who passes through (S3-1). When the "not yet read signal" which is the "reading operation state signal" is not received by the first gate reception antenna 12*a* (S3-1N), the automatic checkout terminal 5*a* or the sales clerk-operated checkout terminal 5*b* so judges that the article N is in the "already read state" in which the "reading operation" is executed for the article N or in the "not possessed state" in which the customer M is not carrying the article N. On the other hand, when the "not yet read signal" is received (S3-1Y), it is so judged that the article N is in the "not yet read state" in which the "reading operation" has not been performed for the article N.

When it is judged at the first gate 22 that the article N is in the "already read state" or in the "not possessed state", the control operation state of the store control unit 28 is shifted to the "first gate passage permit state" permitting the customer M to pass through the first gate 22. On the other hand, when it is judged at the first gate 22 that the article N is in the "not yet read state", the control operation state of the store control unit 28 is shifted to the "takeout precaution state" exercising precaution against the customer M's attempt of taking out the article N in the "not yet read state" from the store 1*a*.

In the "takeout precaution state", the store control unit 28 in the normal store mode produces a prerecorded warning announcement stating that the "checkout operation" has not been finished for the article N, from the gate speaker 49 of the first gate 22, and flashes the gate lamp 48 to warn the customer M. Further, the information lamps 47 are flashed (S3-4) to inform the sales clerks X of the "takeout precaution state" to exercise precaution. In the unattended store mode, the contracted security company 66 is informed of the "takeout precaution state" through the public telephone circuit 65 to request assistance for precaution. A prerecorded warning announcement is produced stating that the "checkout operation" has not been finished for the article N and the gate lamps 48 are flashed to warn the customer M.

Then, the store control unit 28 waits for the reception of the reset signal for resetting the "takeout precaution state" (S3-5). The reset signal can be output from the return box 60 or the sales clerk-operated checkout terminal 5*b* or by the remote operation from the contracted security company 66 when the control operation state is shifted to the "takeout precaution state" against the will of the customer M. When the reset signal is received, the store control unit 28 resets the "takeout precaution state", discontinues the warning announcement, turns the gate lamps 48 and information lamps 47 off (S3-6), and shifts the control operation state to the "first gate passage permit state".

Next, when the customer M passes through the second gate 23 carrying the article N with him in the "first gate passage permit state" or in the "takeout precaution state" of when no reset signal is received at "S3-5", the store control unit 28 receives again, through the second gate reception antenna 12*b*, the "reading operation state signal" from the stuck state detection seal 2 (S3-2). When the "not yet read signal" is not received as the "reading operation state signal" (S3-2N), it is judged again that the article N is in the "already read state" or the customer M is in the "not possessing state". When the "not yet read signal" is received (S3-2Y), on the other hand, it is judged again that the article N is in the "not yet read state".

When it is judged again at the second gate 23 that the article N is in the "already read state" or in the "not possessed state", the control operation state of the store control unit 28 is shifted to the "second gate passage permit state" in which the customer M is permitted to pass through the second gate 23 and go out through the first entrance/exit 3*a*. In the "second gate passage permit state", the store control unit 28 opens the automatic door 29 in response to the operation of the touch switch 29*a* by the customer M (S3-3) to end the takeout prevention processing.

When it is judged at the second gate 23 again that the article N is in the "not yet read state", the control operation state of the store control unit 28 is shifted to the "takeout precaution state" in which the degree of precaution is further enhanced against the customer M's attempt of taking out the article N which is in the "not yet read state" from the store 1*a*.

In the "takeout precaution state" in the ordinary store mode, the store control unit 28 produces, through the gate speaker 49 at the second gate 23, a prerecorded warning announcement stating that the "checkout operation" has not been finished for the article N which may, hence, be taken out without authorization, produces an alarm sound at the same time, and flashes the gate lamps 48 an increased number of times to warn the customer M. Further, the information lamps 47 are flashed an increased number of times to inform the sales clerks X of the "takeout precaution state" to request precaution for preventing the takeout (S3-7), and the monitoring TV cameras 13 are continuously operated to record pictures. In the unattended store mode, the contracted security company 66 is informed of the "takeout precaution state" through the public telephone circuit 65. A guard in charge of the contracted security company 66 directly makes a warning announcement stating that the "checkout operation" has not been finished for the article N which may, hence, be taken out without authorization to thereby warn the customer M.

Thereafter, the store control unit 28 waits for the receipt of a reset signal for resetting the "takeout precaution state" like at "S3-5" (S3-8). When the reset signal is received, the store control unit 28 resets the "takeout precaution state", discontinues the warning announcement, and turns the gate lamps 48 and information lamps 47 off (S3-9) to end the processing.

When no reset signal is received in the "takeout precaution state", the control operation state of the store control unit 28 is shifted to the "takeout prevention state" to prevent the customer M's attempt for taking out the article N from the store 1*a*. In the "takeout prevention state", the store control unit 28 informs the contracted security company 66 and other stores 67 of the "takeout prevention state"-through the public telephone circuit (S3-10), and requests the contracted security company 66 and other stores 67 the assistance for the "takeout prevention state". Further, the automatic door 29 is locked in the closed state (S3-11) to prevent, at the guide passage 51, the customer M who is going to take out the article N in the "not yet read state" from going out and, hence, to keep the customer M stay in the store 1*a*. The takeout prevention processing is, then, finished.

The store 1*a* may be, for example, a convenience store selling merchandise, and can be operated, in the day time, as an attended store where the "checkout operations" are carried out by the sales clerks X and, at night, as an unattended store where the "checkout operations" are carried out by the customers M, enabling the "checkout operation" to be carried out without almost attended by the sales clerks X or without quite attended by the sales clerks X to suppress the labor cost. Further, the first gate 22 judges whether the "reading operation" is executed for the article N and the second gate 23 judges it again, making it possible to greatly enhance the precision of judgement and to improve reliability of the system which is for preventing the takeout without authorization. Besides, since the store control unit 28 is connected to the contracted security company 66 and other stores 67 through the public telephone circuit 65, the control operation state of the store control unit 28 can be monitored from the external side.

The store control unit 28 is so constituted as to judge whether the "checkout operation" is performed for every article N based on a "reading operation state signal" transmitted from the bar code reader 45. Based on the "not yet read signal" received by the gate reception antenna 12 of the takeout monitoring unit 151, therefore, the article N for which the "reading operation" has not been executed is judged to be not to be taken out, and the customer M who is going to leave the store 1*a* is kept to stay in the store 1*a* to thereby prevent the article N from being taken out from the store 1*a* without authorization. It further becomes possible to prevent not only the customers M but also the sales clerks X as well from taking out the articles N without authorization, i.e., to prevent wicked appropriation.

FIG. 8 is a view of layout of the store 1*b* illustrating another example of utilizing the stuck state detection seal 2 according to the invention. This invention can be favorably applied to a store such as a supermarket. The stuck state detection seal 2 shown in FIG. 3 is stuck to each of the articles N that are on display. The sales area in the store 1*b* is provided with entrances/exits at two places through which the customers are allowed to enter and leave, and each entrance/exit is provided with a takeout monitoring unit 151 like the one shown in FIG. 1. Further, the same automatic checkout terminal 5*a* as that of FIG. 1 is arranged on each of the plurality of counters that are installed.

This store 1*b* is capable of executing the stuck state detection processing (S1) of FIG. 5, the checkout operation processing (S2) for the article of FIG. 6, and the takeout prevention processing (S3) of FIG. 7, offering the same effect as that of the store 1*a* of FIG. 1, such as decreasing the number of staffs required for the "checkout operation".

The invention is in no way limited to the above embodiment only but can be put into practice while suitably modifying the shapes and constitutions of the portions in a manner as described below without departing from the gist and scope of the invention.

(1) The shapes of the sealing base member and the sealing surface member are not limited to rectangular shapes, but may be round shapes, elliptic shapes, circular shapes, oval shapes or polygonal shapes.

(2) The stuck state detection seals 2 are arranged in advance on a pasteboard that has been rolled, and may be stuck to the articles N in the stores 1*a*, 1*b* by using a sticking device that works to peel the seals off the pasteboard piece by piece to stick them onto the articles N, i.e., by using a so-called labeler. This saves the labor of the sticking operation.

(3) The stuck state detection seal 2 may be provided with starter switching means which, when stuck to an article N, starts supplying power from a power source to start the operations of the constituent means. Provision of the starter switching means eliminates the consumption of electric power of before being stuck, and extends the period of time in which the stuck state detection seal 2 can be used.

(4) The number of the switching portions 33*a* of the stuck state detection seal 2 is not limited to 22 places only provided they are formed at portions where the seal can be easily peeled off the article. They can be provided at corner portions and at the central portions along each of the sides at a total number of, for example, 8 or at any plural number, as required.

(5) The stuck state detection system according to the invention can be applied not only to the merchandize sales stores 1*a*, 1*b* such as convenience stores and supermarkets shown in FIGS. 1 and 8 but also to bookstores that sell books as well as to stores offering any other services, such as renting shops renting CDs and the like.

(6) The shutter which is the isolation means is not limited to the one that is raised and lowered, but may be the one that is drawn sideways.

(7) The takeout monitoring unit 151 which is the takeout monitoring means is not limited to the one of the two-step type for the first and second gates 22, 23, but may be of the one-step type provided for either one gate. In this case, the unauthorized takeout is prevented with a simple system constitution.

As described above in detail, the invention of the first aspect is provided with the stuck state detection means, making it possible to transmit a stuck state signal that is detected from the stuck state detection seal to a receiver unit and to manage the attempt of peeling the seal off the article stuck with the seal based on the stuck state signal.

The invention of the second aspect is provided with switching means which performs the switching operation depending upon the stuck state, making it possible to reliably generate a switched state signal from the switched state signal generating means relying upon a simple constitution.

The invention of the third aspect is provided with the takeout state signal transmission/reception means, and makes it possible to write a takeout state signal that is received into the storage means, to transmit the takeout state signal that is written to the receiver unit, and to manage the takeout state of the article stuck with the seal based on the takeout state signal.

The invention of the fourth aspect detects the attempt for peeling the stuck state detection seal off the article stuck with the seal within predetermined areas. Namely, the invention perceives the attempt for breaking the seal that is stuck, and prevents shoplifting.

The invention of the fifth aspect detects the attempt for peeling the stuck state detection seal off the article stuck with the seal, and prevents the article stuck with the seal from being taken out from the predetermined area without authorization. The invention can be utilized in the merchandize sales stores such as convenience stores and supermarkets to decrease personnel required for the checkout operation.

What is claimed is:

1. A stuck state detection seal comprising:

a sealing base member to be stuck to an article; and a sealing surface member to be stuck to said article being overlapped on said sealing base member;

wherein a stuck state detection means for detecting a stuck state between said sealing base member and said sealing surface member and for generating a stuck state signal that represents the detected stuck state, and a stuck state signal transmission means for transmitting said stuck state signal are provided between said sealing base member and said sealing surface member.

2. A stuck state detection seal according to claim 1, wherein said stuck state detection means includes:

a switching means for switching operation depending upon a stuck state between said sealing base member and said sealing surface member;

a switched state signal generating means for generating a switched state signal corresponding to the switching operation of said switching means, and a control means for generating a stuck state signal corresponding to the switched state signal that is generated.

3. A stuck state detection seal according to claim 1, wherein a takeout state signal transmission/reception means for transmitting and receiving a takeout state signal representing whether an article with the seal is authorized to be taken out from a predetermined area is provided between said sealing base member and said sealing surface member.

4. A stuck state detection seal according to claim 2, wherein a takeout state signal transmission/reception means for transmitting and receiving a takeout state signal representing whether an article with the seal is authorized to be taken out from a predetermined area is provided between said sealing base member and said sealing surface member.

5. A stuck state detection system for detecting, in a predetermined area, the stuck state between the sealing base member and the sealing surface member of the stuck state detection seal of claim 1, wherein a stuck state signal reception means for receiving a stuck state signal transmitted from said stuck state detection seal is provided.

6. A stuck state detection system for detecting, in a predetermined area, the stuck state between the sealing base member and the sealing surface member of the stuck state detection seal of claim 2, wherein a stuck state signal reception means for receiving a stuck state signal transmitted from said stuck state detection seal is provided.

7. A stuck state detection system for detecting, in a predetermined area, the stuck state between the sealing base member and the sealing surface member of the stuck state detection seal of claim 3 and for preventing unauthorized takeout of an article to which the stuck state detection seal is stuck, comprising:

a stuck state signal reception means for receiving a stuck state signal transmitted from said stuck state detection seal;

a takeout state signal transmission means for transmitting a takeout state signal to the takeout state signal transmission/reception means in said stuck state detection seal;

a takeout state signal reception means for receiving a takeout state signal transmitted from said takeout state signal transmission/reception means, and a judging means for judging whether the takeout of the article stuck with the seal is permitted or not based upon the takeout state signal received by said takeout state signal reception means, wherein the stuck state is detected based on the stuck state signal received by said stuck state signal reception means, and unauthorized takeout of said article stuck with the seal is prevented based on the judgement by said judging means.

8. A stuck state detection system for detecting, in a predetermined area, the stuck state between the sealing base member and the sealing surface member of the stuck state detection seal of claim 4 and for preventing unauthorized takeout of an article to which the stuck state detection seal is stuck, comprising:

a stuck state signal reception means for receiving a stuck state signal transmitted from said stuck state detection seal;

a takeout state signal transmission means for transmitting a takeout state signal to the takeout state signal transmission/reception means in said stuck state detection seal;

a takeout state signal reception means for receiving a takeout state signal transmitted from said takeout state signal transmission/reception means, and a judging means for judging whether the takeout of the article stuck with the seal is permitted or not based upon the takeout state signal received by said takeout state signal reception means, wherein the stuck state is detected based on the stuck state signal received by said stuck state signal reception means, and unauthorized takeout of said article stuck with the seal is prevented based on the judgement by said judging means.

* * * * *